US012540736B2

(12) United States Patent
Koh

(10) Patent No.: US 12,540,736 B2
(45) Date of Patent: Feb. 3, 2026

(54) VERTICALLY MOVABLE BRACKET ASSEMBLY FOR SUPPORTING ELECTRIC RANGE

(71) Applicant: Jaeho Koh, Seongnam-si (KR)

(72) Inventor: Jaeho Koh, Seongnam-si (KR)

( * ) Notice: Subject to any disclaimer, the term of this patent is extended or adjusted under 35 U.S.C. 154(b) by 0 days.

(21) Appl. No.: 18/659,228

(22) Filed: May 9, 2024

(65) Prior Publication Data

US 2025/0020334 A1 Jan. 16, 2025

(30) Foreign Application Priority Data

Jul. 14, 2023 (KR) ..... 10-2023-0091470

(51) Int. Cl.
*F16M 11/00* (2006.01)
*F24C 15/30* (2006.01)

(52) U.S. Cl.
CPC ..... *F24C 15/30* (2013.01)

(58) Field of Classification Search
CPC ..... F24C 15/30; F24C 15/103; F24C 15/108; F24C 15/08; F24C 7/00; A47B 77/08
See application file for complete search history.

(56) References Cited

U.S. PATENT DOCUMENTS 3,229,310 A * 1/1966 Ensch ..... E03C 1/335 4/619
3,392,720 A * 7/1968 Sherman ..... F24C 15/30 126/211
7,185,379 B2 * 3/2007 Barman ..... A47C 27/146 5/717
10,378,193 B2 * 8/2019 Smith ..... E03C 1/335

FOREIGN PATENT DOCUMENTS

CN 204404262 U 6/2015
CN 202733972 U 2/2023
KR 10-2022-0048849 A 4/2022
KR 10-2503680 B1 2/2023

* cited by examiner

*Primary Examiner* — Amy J. Sterling
(74) *Attorney, Agent, or Firm* — KORUS Patent, LLC; Seong Il Jeong

(57) ABSTRACT

Disclosed herein is an electric range supporting bracket assembly for seating an electric range on a countertop having an opening. The electric range supporting bracket assembly includes a frame part configured to be coupled to a countertop, a support part configured such that an electric range is seated thereon, and an adjustment part configured to apply external force to the support part. The support part is inserted into the inner space of the frame part and moved vertically to adjust the height of the seated electric range.

8 Claims, 7 Drawing Sheets

VERTICALLY MOVABLE BRACKET ASSEMBLY FOR SUPPORTING ELECTRIC RANGE

CROSS-REFERENCE TO RELATED APPLICATION

This application claims the benefit of Korean Patent Application No. 10-2023-0091470 filed on Jul. 14, 2023, which is hereby incorporated by reference herein in its entirety.

BACKGROUND

1. Technical Field

The present invention relates to a bracket assembly for supporting an electric range, and more particularly, to a vertically movable electric range supporting bracket assembly that supports an electric range that is located in the opening of the countertop of a kitchen.

2. Description of the Related Art

Electric ranges are cooking appliances that generate heat with electricity, and are classified into hot plates, inductions, and highlights depending on their heating elements. In this case, compared to gas ranges, which are inevitably dependent on gas pipes, electric ranges can be installed anywhere where there is an electric outlet, have neat design, and are superior in convenience and safety, so that their market share is increasing worldwide.

There are portable electric ranges, but most electric ranges are installed in a built-in manner. The built-in type installation is performed by drilling a hole through the top and bottom of a kitchen top so that it is slightly smaller than the size of an electric range and then seating the electric range around the top end of the kitchen top.

However, in the above built-in type installation, an electric range is located to be higher than the kitchen top. When heavy kitchenware collides with the stepped peripheral portion of the electric range, the possibility that the electric range is damaged increases. Accordingly, there are required additional measures for protecting the peripheral portion of the electric range, such as a separate frame installed on the peripheral portion of the electric range.

Korean Patent No. 10-2503680 (published on Feb. 21, 2023) discloses an invention regarding a bracket assembly for supporting an electric range that is attached to a countertop and supports an electric range by using a method in which the periphery of the electric range is seated on the bracket assembly for supporting an electric range rather than a method in which the periphery of the electric range is seated around the top of a countertop.

When this bracket assembly for supporting an electric range is used, the top surface of a countertop and the top surface of an electric range do not form a step and can be installed to be level with each other. Accordingly, there is no need for additional measures for protecting the peripheral portion of the electric range.

However, the conventional invention has poor compatibility with various types of electric ranges and countertops of different specifications, and also has many difficulties in leveling an electric range and a countertop with each other so that they are flat.

SUMMARY

The present invention is intended to overcome the above-described problems, and an object of the present invention is to provide a bracket assembly for supporting an electric range that can move vertically.

However, objects of the present invention to be achieved by some embodiments are not limited to the object described above, and there may be present other objects.

According to an aspect of the present invention, there is provided an electric range supporting bracket assembly for seating an electric range on a countertop having an opening, the electric range supporting bracket assembly including: a frame part configured to be coupled to a countertop; a support part configured such that an electric range is seated thereon; and an adjustment part configured to apply external force to the support part; wherein the support part is inserted into the inner space of the frame part and moved vertically to adjust the height of the seated electric range.

The frame part may include a first frame portion configured to come into contact with the countertop and a second frame portion configured such that the support part is inserted thereinto, and the second frame portion may be formed to protrude upward from the first frame portion.

The top surface of the first frame portion may include: an inclined surface inclined downward; a horizontal surface configured to continuously extend from the inclined surface and be parallel to a ground surface; and a depression and protrusion surface configured to continuously extend from the horizontal surface, and provided with alternating depressions and protrusions.

The bottom surface of the first frame portion may have recessed spaces formed by being recessed to a predetermined height in an upward direction, and a cross-shaped reinforcing member may be formed among the recessed spaces.

The support part may include: one or more first support portions configured to be inserted into the inner space of the frame part and guide vertical movement; a second support portion located between the first support portions, and configured to receive external force required for elevation; and a third support portion configured such that the electric range is seated thereon.

The bottom surface of the second support portion may be provided with an internal space recessed upward, and an external force application member may be selectively attached to and detached from the internal space.

The external force application member may include a first external force application member having a height equal to the depression depth of the internal space, and a second external force application member having a height higher than the depression depth of the internal space and protruding downward; and the external force application member may be replaceable depending on a thickness of the countertop.

The top surface of the third support portion may have grooves depressed in a downward direction and a hole penetrating in a vertical direction.

The adjustment part may include: a first adjustment portion in the form of a nut that is inserted into and fixed to the inner space of the frame part; and a second adjustment portion in the form of a bolt that is fastened to the first adjustment portion.

The adjustment part may further include a third adjustment portion in the form of a nut that is located in a space outside the frame part and is fastened to the second adjustment portion.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Specific embodiments of the present invention will be described in detail below with reference to the drawings. However, the spirit of the present invention is not limited to the presented embodiments, and a person skilled in the art who understands the spirit of the present invention may easily propose one or more other embodiments falling within the scope of the present invention through the addition, changing, deletion, and/or the like of one or more other components within the scope of the same spirit. These will also be considered to be included within the scope of the present invention.

Figure 1:
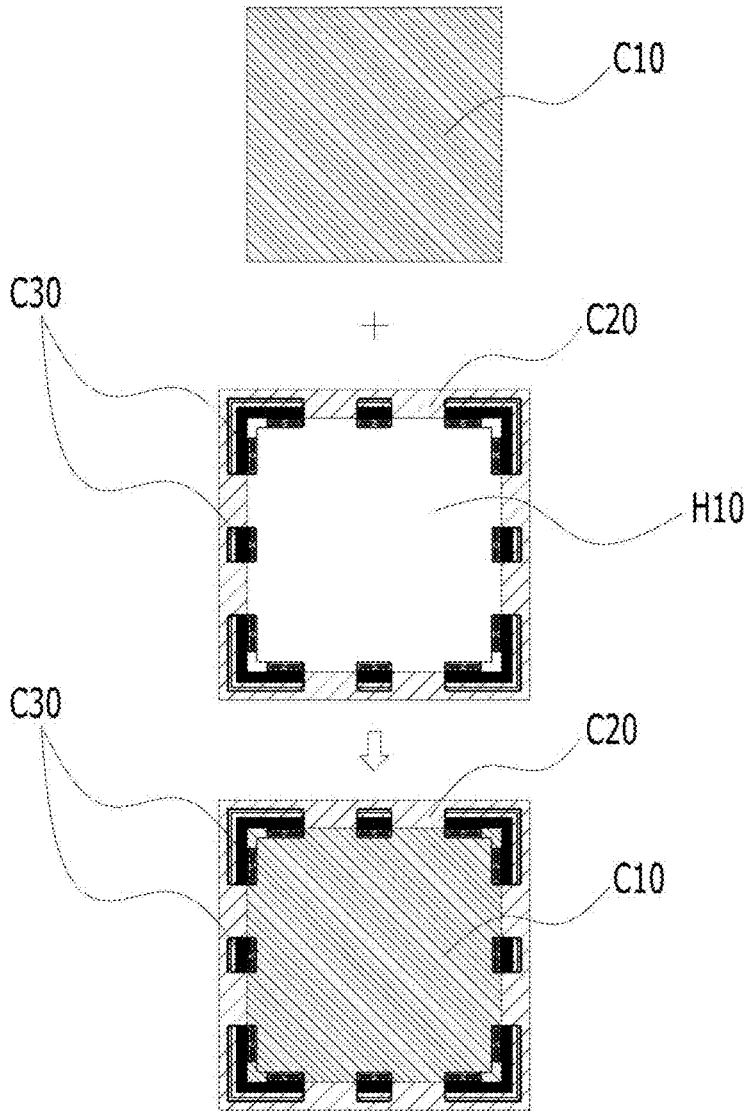
FIG. 1 is a diagram schematically showing a situation in which an electric range is installed on a countertop by using bracket assemblies according to an embodiment of the present invention.

FIG. 1 is a diagram schematically showing a situation in which an electric range C10 is installed on a countertop C20 by using bracket assemblies C30 according to an embodiment of the present invention.

Referring to FIG. 1, one end of each of the bracket assemblies C30 is coupled to the bottom surface of the countertop C20 in which an opening H10 is formed, and the other end of the bracket assembly C30 is exposed in the opening H10 and can support the bottom surface of the electric range C10 and allow it to be seated thereon. In this case, the other end of the bracket assembly C30 is movable vertically such that the top surface of the countertop C20 and the top surface of the electric range C10 do not form a step and can be installed to be level with each other.

The bracket assembly C30 will be described in detail below.

Figure 2:
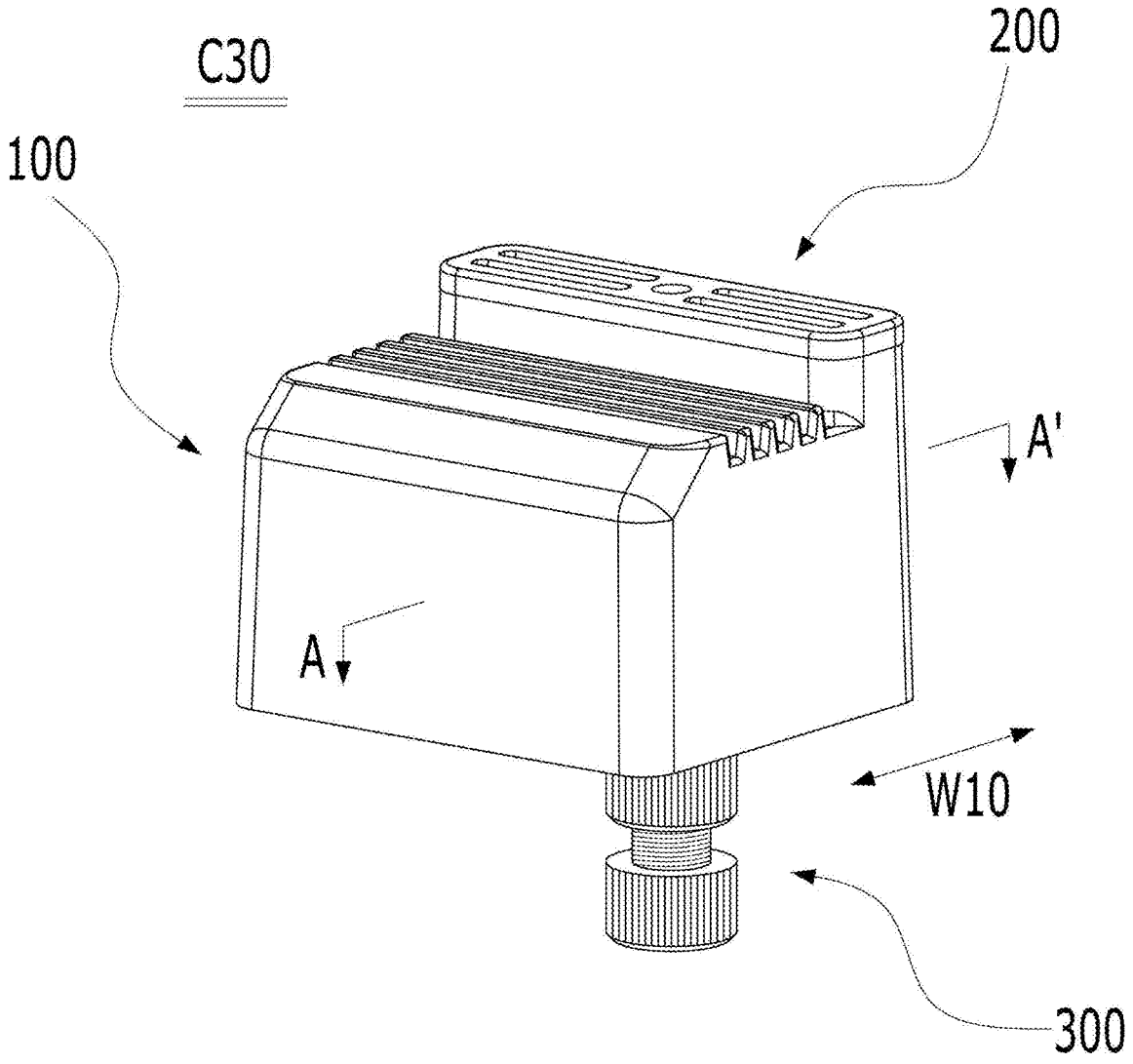
FIG. 2 is an overall perspective view of a bracket assembly according to an embodiment of the present invention.

FIG. 2 is an overall perspective view of a bracket assembly according to an embodiment of the present invention.

Referring to FIG. 2, the bracket assembly C30 may include a frame part 100 configured to be coupled to the countertop C20, a support part 200 configured such that the electric range C10 is mounted thereon, and an adjustment part 300 configured to apply external force to the support part 200. In this case, the support part 200 may be introduced into the inner space of the frame part 100 and moved vertically to adjust the height of the seated electric range C10.

Figure 3A:
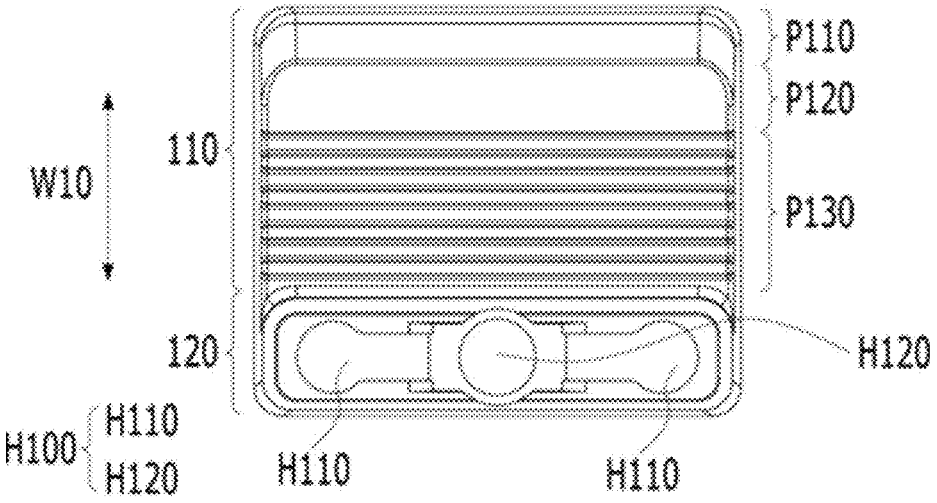
FIGS. 3A, 3B and 4 are views illustrating the frame part of a bracket assembly according to an embodiment of the present invention.
Figure 3B:
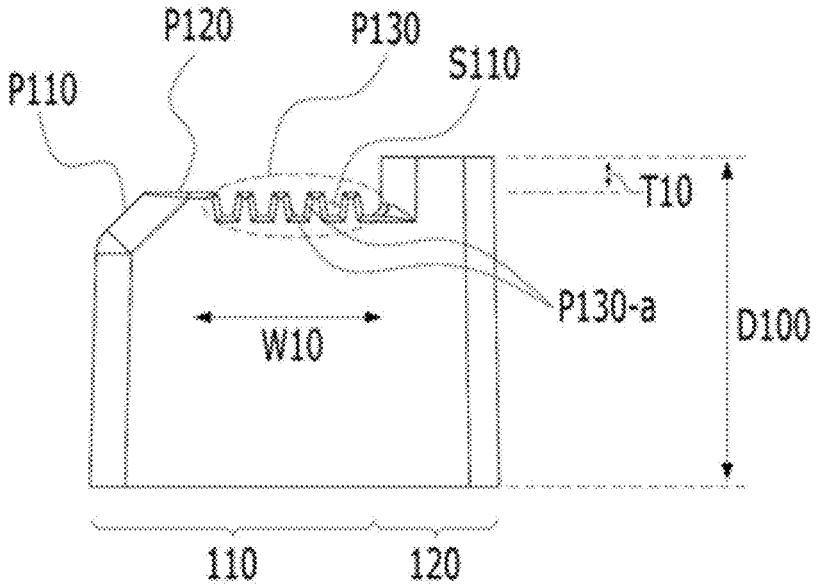
Figure 4:
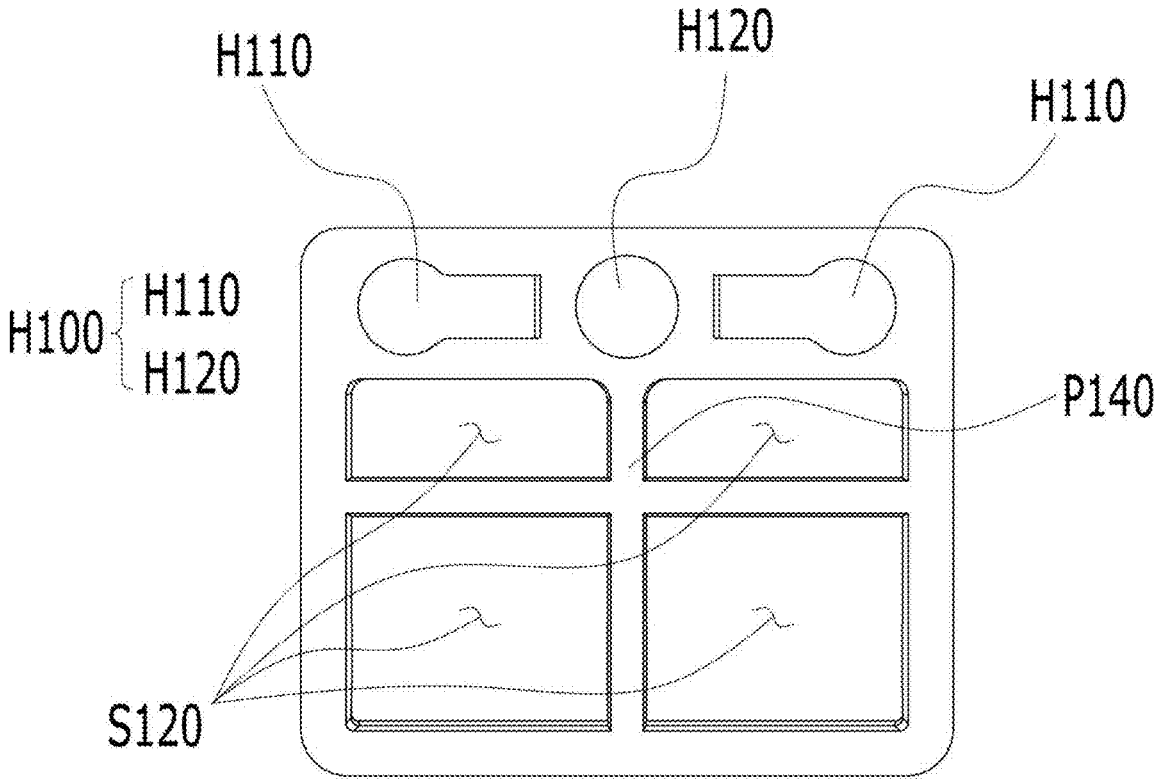

FIGS. 3A, 3B and 4 are views illustrating the frame part of a bracket assembly according to an embodiment of the present invention. More specifically, FIG. 3A is a top view of the frame part, FIG. 3B is a side view of the frame part, and FIG. 4 is a bottom view of the frame part.

Referring to FIGS. 3A, 3B and 4, the frame part 100 may include a first frame portion 110 configured to come into contact with the countertop C20, and a second frame portion 120 configured such that the support part 200 is inserted thereinto.

As an example, the top surface of the first frame portion 110 may include an inclined surface P110 inclined downward, a horizontal surface P120 configured to continuously extend from the inclined surface P110 and be parallel to the ground surface, and a depression and protrusion surface P130 configured to continuously extend from the horizontal surface P120 and provided with alternating depressions and protrusions.

In this case, the inclined surface P110 is inclined downward at a predetermined angle, thereby causing the slip of an arbitrary tool (e.g., a knife or scraper) and thus facilitating the easy entry of the tool into the space between the top surface of the first frame part 100 and the bottom surface of the countertop C20. As a result, the first frame part 100 may be easily separated from the countertop C20. In this case, the predetermined angle is preferably 45 degrees, but it is not limited thereto and may be modified in various manners within the range in which they are obvious to those skilled in the art.

Furthermore, the horizontal surface P120 is formed between the inclined surface P110 and the depression and protrusion surface P130 over a predetermined distance in the longitudinal direction W10, thereby facilitating the entry of any tool that slips on the inclined surface P110. Furthermore, when some of the adhesive material applied to the depression and protrusion surface P130 overflows, the horizontal surface P120 may serve as a barrier that prevents the adhesive material from flowing to the inclined surface P110. In this case, some excess adhesive material is also applied to the horizontal surface P120, so that the horizontal surface P120 can be coupled to the bottom surface of the countertop C20, thereby further increasing the fixation force.

Furthermore, the depression and protrusion surface P130 is a surface on which the adhesive material is applied. The adhesive material may be applied to downwardly depressed spaces S110, thereby increasing the area on which the adhesive material is applied. As a result, the depression and protrusion surface P130 may have improved adhesion force compared to a flat surface formed of the same length in the longitudinal direction W10. Furthermore, the depression and protrusion surface P130 may have depressed inclined surfaces P130-*a* inclined downward, thereby facilitating the flow of the adhesive material into the depressed spaces S110.

Furthermore, in order to increase the fixation force from the bottom surface of the countertop C20, the depression depth of the depression and protrusion surface P130 may be adjustable, and the distance of the depression and protrusion surface P130 in the longitudinal direction W10 may also be adjustable. As an example, in order to increase the fixation force from the bottom surface of the countertop C20, the depression depth of the depression and protrusion surface P130 may be adjusted to a deeper value, and the distance of the depression and protrusion surface P130 in the longitudinal direction W10 may be adjusted to a longer value.

Next, the bottom surface of the first frame portion 110 may be provided with recessed spaces S120 formed by being recessed upward to a predetermined depth, and a cross-shaped reinforcing member P140 may be provided among the recessed spaces S120.

As an example, the bottom surface of the first frame portion 110 is recessed upward to a predetermined depth to form the recessed spaces S120, thereby reducing the weight of bracket assembly.

Furthermore, in order to structurally reinforce the lightweight member, the cross-shaped reinforcing member P140 may be formed among the recessed spaces S120, so that the four recessed spaces S120 are formed.

Furthermore, in the case where the bracket assembly C30 is installed, when the side portions of the first frame portion 110 cannot be gripped with the fingers due to adhesive material or a small installation space, the reinforcing material P140 may be gripped by inserting fingers into the recessed spaces S120 separated by the reinforcing material P140.

As an example, by inserting the thumb and the index finger into the wide section of the wide recessed spaces S120 and then holding the reinforcing member P140 with the thumb and the index finger, the bracket assembly C30 may be sufficiently installed even without gripping the side portions of the first frame portion 110 with the fingers.

Next, the second frame portion 120 may be formed to protrude upward from the first frame portion 110. This is intended to prevent the adhesive material applied to the first frame part 110 from interfering with the support part 200. Furthermore, in coupling with the countertop C20, the side of the opening T10 of the countertop C20 comes into contact with and is caught on the protruding second frame portion 120. When the bracket assembly C30 is installed, the error of an operator may be prevented and installation may be facilitated. In this case, the protrusion height T10 of the second frame portion 120 may be smaller than the difference between the thickness of the countertop C20 and the thickness of the electric range C10. As an example, the protrusion height T10 may be 10 mm, but it is not limited to this and may be modified in various manners within the range in which they are obvious to those skilled in the art.

Furthermore, the support part 200 may be inserted into the second frame portion 120. Due to this, an internal space H100 penetrating in the vertical direction may be formed in the second frame portion 120.

As an example, the internal space H100 of the second frame portion 120 may include a first hole H110 configured to receive the support part 200 and a second hole H120 configured to receive the adjustment part 300. In this case, the first hole H110 may be formed to have a shape corresponding to that of the support part 200 to be inserted, and the first hole H110 may be divided into two portions on both sides based on the second hole H120. This may be intended to serve as rails that effectively guide the support part 200 when the support part 200 is inserted into or discharged from the second frame portion 120.

Furthermore, the second hole H120 may be used as a path through which the adjusting portion 300 is selectively inserted and discharged. As an example, a first adjustment part 310 to be described later may be placed and fixed in the second hole H120. A second adjustment part 320 to be described later may be fastened to the first adjustment part 310 and moved vertically.

Figure 5A:
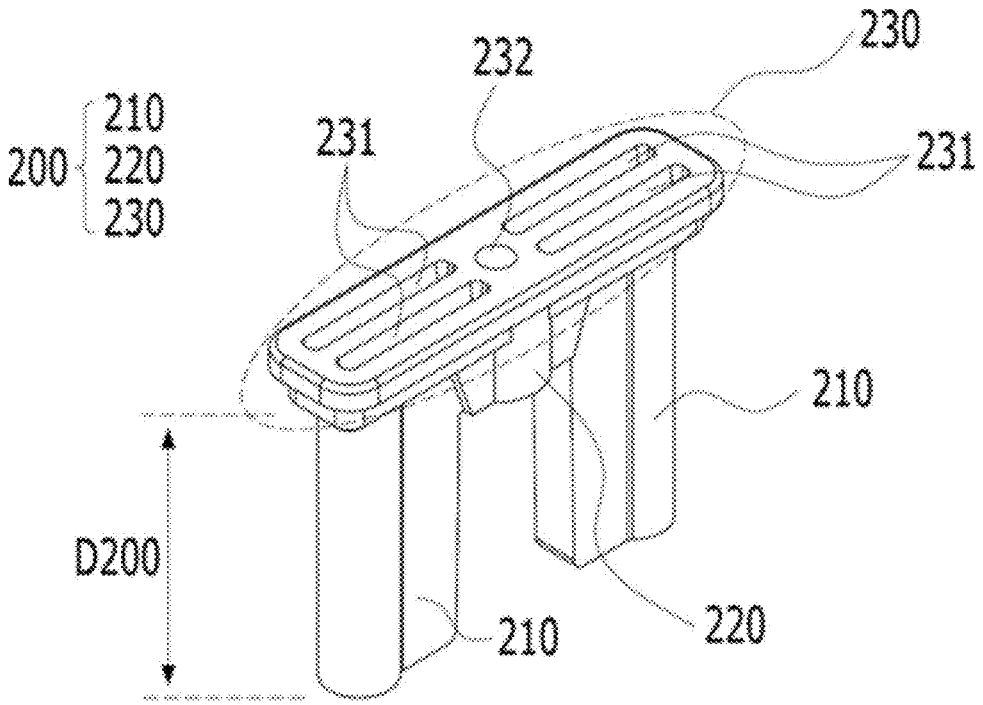
FIGS. 5A, 5B are a diagram illustrating the support part of a bracket assembly according to an embodiment of the present invention.
Figure 5B:
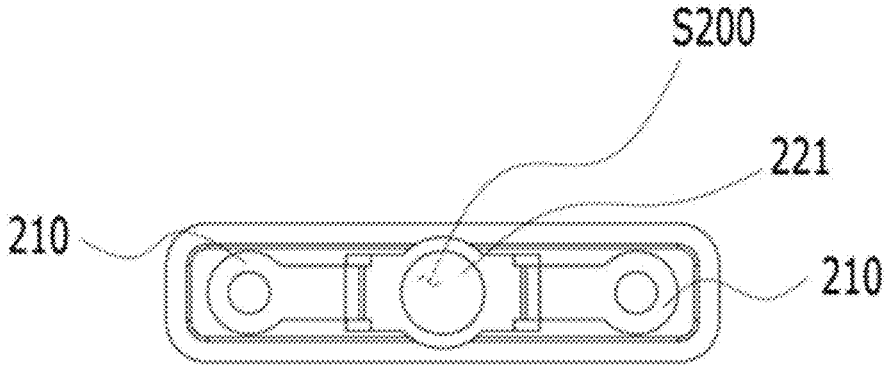
Figure 6:
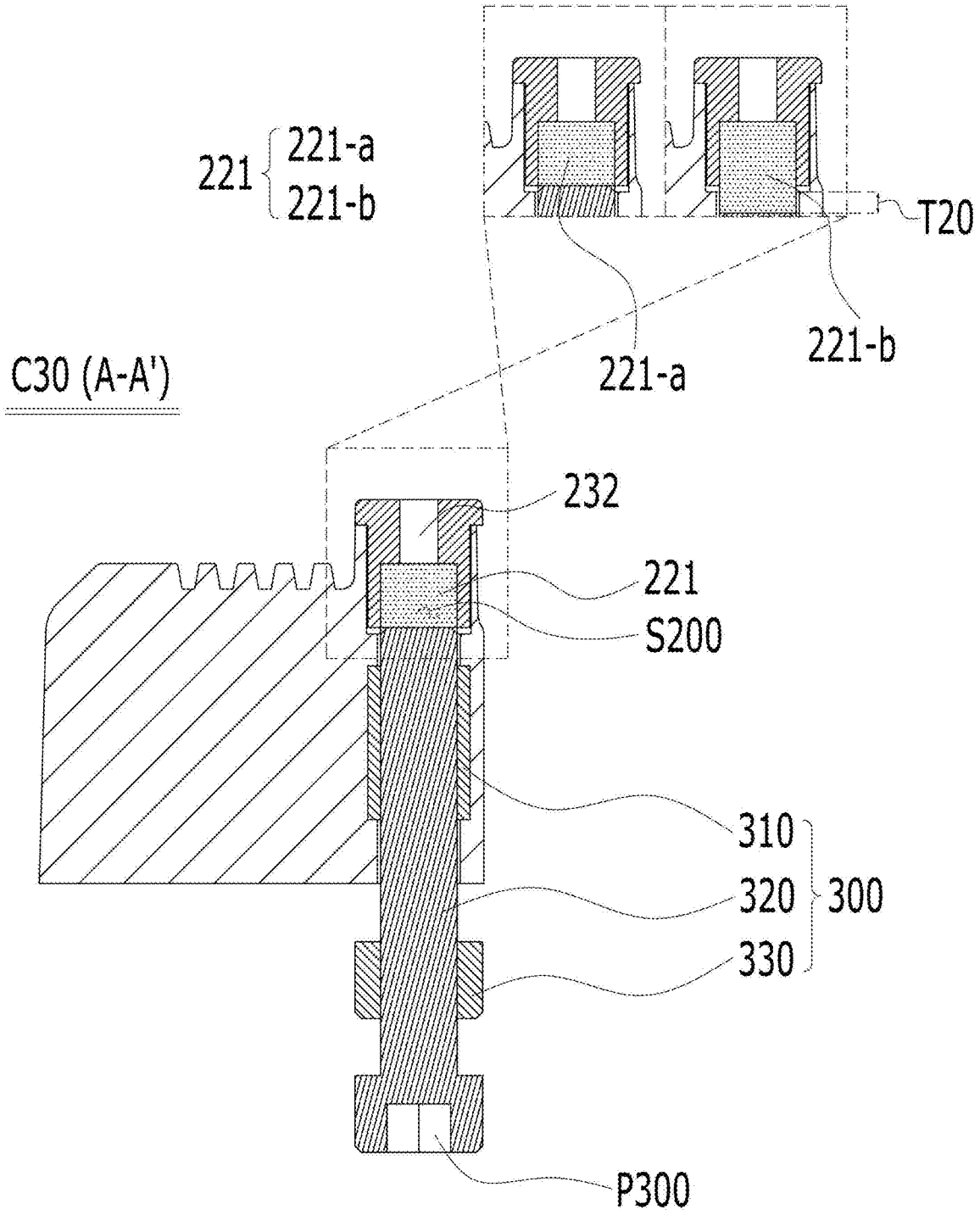
FIG. 6 is a sectional view of a bracket assembly according to an embodiment of the present invention.

FIGS. 5A, 5B are a diagram illustrating the support part of a bracket assembly according to an embodiment of the present invention, and FIG. 6 is a sectional view of a bracket assembly according to an embodiment of the present invention.

More specifically, FIG. 5A is a perspective view of the support part, FIG. 5B is a bottom view of the support part, and FIG. 6 is a sectional view of the bracket assembly taken along direction A-A' of FIG. 2.

Referring to FIGS. 5A, 5B and 6, the support part 200 may include first support portions 210 configured to be inserted into the inner space H100 of the frame part 100 and guide vertical movement, a second support portion 220 located between the first support portions 210 and configured to receive external force required for elevation, and a third support portion 230 configured such that the electric range C10 is seated thereon.

As an example, the first support portion 210 may be shaped like a combination of a cylinder and a square pillar in order to be inserted into the internal space H100 of the frame part 100 and effectively guide vertical movement. The reason for this is that when the first support portion 210 is formed only in the shape of a square pillar, movement interference occurs in such a manner that the ends of the outer corners of the square pillar are stabbed or caught in the internal space of the frame part during vertical movement. In the present invention, a shape in which a cylinder and a square pillar are combined with each other is applied such that the ends of the outer corners have curved shapes, thereby making them robust against movement interference.

Furthermore, the first support portions 210 may be disposed on both sides of the second support part 220. In this case, when vertical movement is guided, a case where the first support portion 210 is composed of multiple portions and arranged on both sides performs more effective guidance than a case where the first support portion 210 is composed of a single portion.

Furthermore, the first support portions 210 are coupled to the bottom surface of the third support portion 230 and protrude downward therefrom. In this case, the protrusion length D200 (see FIGS. 5A, 5B) of the first support portions 210 may be the same as or longer than the height D100 (see FIGS. 3A, 3B) of the second frame portion 120.

Furthermore, the first support portions 210 may be designed to be caught on the second frame portion 120 when it reaches its maximum rising height. As an example, first protrusions (not shown) may be formed at both side ends of the bottom surface of the first support portions 210, and second protrusions (not shown) may be formed at both side ends of the inner space of the second frame portion 120. Furthermore, the first protrusions and the second protrusions may be designed to engage with each other so that the first support portions 210 are not completely separated from the second frame portion 120. However, the first support portions 210 are not limited thereto, and may be modified in various manners within the range in which they are obvious to those skilled in the art.

Next, the second support portion 220 may be located between the first support portions 210 and receive the external force required for elevation. In this case, the bottom surface of the second support portion 220 is provided with an internal space S200 recessed upward, and an external force application member 221 may be attached to and detached from the internal space S200.

When external force is applied in the upward direction by the adjustment part 300, the area receiving the external force is gradually worn. Accordingly, when the separate external force application member 221 having excellent wear resistance is provided, the upward external force may be effectively applied without the wear caused by the external force of the adjustment part 300. In this case, the material of the external force application member 221 may be a metal material having strong wear resistance, but it is not limited thereto and may be modified in various manners within the range in which they are obvious to those skilled in the art.

Furthermore, the external force application member 221 may include a first external force application member 221-*a* having a height equal to the depression depth of the internal space S200, and a second external force application member 221-*b* having a height higher than the depression depth of the internal space S200 and protruding downward. The external force application member 221 is replaceable depending on the thickness of the countertop C20.

As an example, when the thickness of the countertop C20 is thick, the maximum rising height of the support part 200 needs to be changed to a higher value to be compatible with the thickness. In this case, when replacement with the second external force applying member 221-*b* is performed, the maximum rising height will be increased by the protrusion height T20 (see FIG. 6) of the replaced second external force application member 221-*b*.

In this case, a hole 232 penetrating in the vertical direction may be formed in the top surface of the third support portion 230 at a position corresponding to the second support portion 220. This may facilitate the entry of the external force application member 221 into the internal space S200 by discharging the air pressure generated when the external force application member 221 enters the internal space S200. Furthermore, when the external force application member 221 is replaced, the discharge of the external force application member 221 may be facilitated by inserting a thin and long member such as an awl into the hole 232 and thus push out the external force application member 221. Accordingly, the bracket assembly C30 of the present invention may have excellent compatibility even with various thicknesses of the countertop C20.

Furthermore, grooves 231 recessed in the downward direction may be formed in the top surface of the third support portion 230. This is intended to guide an adhesive material to a position where the adhesive material is applied when the adhesive material is applied to the top surface of the third support portion 230. This may be intended to increase adhesive force by increasing the amount of adhesive material applied compared to a case where the grooves are not formed.

However, the third support portion 230 is not limited thereto and may be modified in various manners within the range in which they are obvious to those skilled in the art.

Next, the adjustment part 300 may include: a first adjustment portion 310 in the form of a nut that is inserted into and fixed to the inner space H100 of the frame part 100; and a second adjustment portion 320 in the form of a bolt that is fastened to the first adjustment portion 310.

As an example, the adjustment part 300 serves to apply external force to the support part 200, and may apply external force to the support part 200 through a bolt fastening method. More specifically, the first adjustment portion 310 formed in the shape of a nut is inserted into and fixed to the second hole H120 of the second frame portion 120. When the second adjustment portion 320 formed in the shape of a bolt is fastened to the first adjustment portion 310 and rotate the head of the second adjustment portion 320, external force may be applied to the support part 200 in such a manner that the end of the body of the second adjustment portion 320 is raised or lowered.

In this case, the head of the second adjustment portion 320 may have a circular shape, and the side of the head may have protrusions formed to improve a grip feeling and enable the fine adjustment of the bolt. Furthermore, a hexagon-shaped recessed portion P300 may be formed in the top surface of the head so that a hexagonal wrench can be inserted thereinto. This may be intended to fasten a bolt using a hexagon wrench when the seated electric range C10 is heavy.

Furthermore, the body length of the second adjustment portion 320 may be replaceable. As an example, in order to improve the maximum rising height of the support part 200, the body length of the second adjustment portion 320 may be replaced with a longer one. Accordingly, the bracket assembly C30 of the present invention may have excellent compatibility even with various thicknesses of the countertop C20.

Furthermore, the adjustment part 300 may further include a third adjustment portion 330 in the form of a nut that is located in a space outside the frame part 100 and is fastened to the second adjustment portion 320. This means that when height adjustment is completed through the first adjustment portion 310 and the second adjustment portion 320, the third adjustment portion 330 may be used to completely fix the adjusted height. Furthermore, the third adjustment portion 330 may be used to finely adjust the height primarily adjusted by the second adjustment portion 320. In this case, the shape of the third adjustment portion 330 may be circular. The side of the third adjustment portion 330 may have protrusions formed to improve a grip feeling and enable the fine adjustment of the bolt.

However, the adjustment part 300 is not limited thereto, and may be modified in various manners within the range in which they are obvious to those skilled in the art.

Redundant descriptions that overlap the foregoing descriptions will be omitted below.

Figure 7:
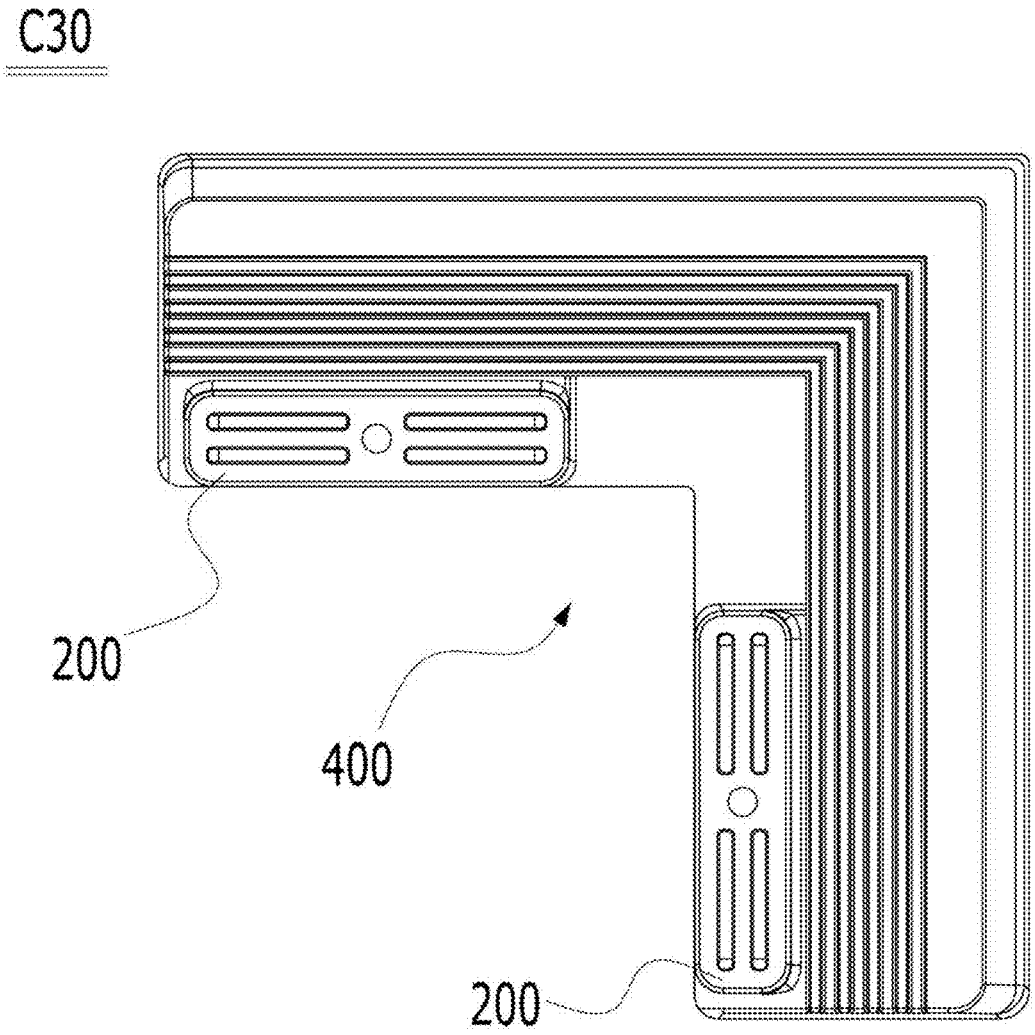
FIG. 7 is a diagram showing a bracket assembly according to another embodiment of the present invention.

FIG. 7 is a diagram showing a bracket assembly according to another embodiment of the present invention.

Referring to FIG. 7, the bracket assembly according to another embodiment of the present invention may have a reversed and inverted 'L'-shaped body portion 400 when viewed from above. This is another embodiment for reinforcing the corners of the opening of the countertop C20 when the perimeter of the electric range C10 is larger than a predetermined size. One or more support parts 200 capable of moving vertically may be provided on respective sides of the reversed and inverted 'L'-shaped body portion 400. In this case, the body part 400 corresponds to the frame part 100 described above, and a detailed description thereof will be omitted.

Furthermore, a square-shaped body part 400 may be applied, and thus one or more support parts 200 that can move vertically are applied to respective sides of the square-shaped body part 400. That is, the shape of the body part 400 is not limited thereto, and may be modified in various manners to correspond to the shapes of the electric range C10 and the countertop C20.

The bracket assembly for supporting an electric range according to the present invention may have excellent compatibility with various types of electric ranges and countertops of different specifications due to the external force application member and adjustment part that are easy to attach and detach.

Furthermore, the height of the electric range may be finely adjusted through the adjustment part, and the adjusted height may be fixed such that it does not change.

Furthermore, the bracket assembly may serve as a lower reinforcing member to prevent the countertop or electric range from being damaged by external shock, and may be easily attached to and detached from the countertop.

However, the advantages of the present invention are not limited to the advantages described above, and advantages not described above may be clearly understood by those skilled in the art from the present specification and the accompanying drawings.

In the accompanying drawings, in order to more clearly describe the technical spirit of the present invention, components that are unrelated or less relevant to the technical spirit of the present invention are briefly illustrated or omitted.

In the foregoing description, the configurations and features of the present invention have been described based on the embodiments according to the present invention, but the present invention is not limited thereto. It is obvious to those skilled in the art that various changes or modifications may be made within the spirit and scope of the present invention. Therefore, it is noted that such changes or modifications fall within the scope of the attached patent claims.

What is claimed is:

1. An electric range supporting bracket assembly for seating an electric range on a countertop having an opening, the electric range supporting bracket assembly comprising:

a frame part configured to be coupled to a countertop;

a support part configured such that an electric range is seated thereon; and an adjustment part configured to apply external force to the support part;

wherein the support part is inserted into an inner space of the frame part and moved vertically to adjust a height of the seated electric range;

wherein the frame part includes a first frame portion configured to come into contact with the countertop and a second frame portion configured such that the support part is inserted thereinto;

wherein the second frame portion is formed to protrude upward from the first frame portion; and wherein a bottom surface of the first frame portion has recessed spaces formed by being recessed to a predetermined height in an upward direction, and a reinforcing member is formed among the recessed spaces.

2. An electric range supporting bracket assembly for seating an electric range on a countertop having an opening, the electric range supporting bracket assembly comprising:

a frame part configured to be coupled to a countertop;

a support part configured such that an electric range is seated thereon; and an adjustment part configured to apply external force to the support part;

wherein the support part is inserted into an inner space of the frame part and moved vertically to adjust a height of the seated electric range;

wherein the frame part includes a first frame portion configured to come into contact with the countertop and a second frame portion configured such that the support part is inserted thereinto;

wherein the second frame portion is formed to protrude upward from the first frame portion; and wherein a top surface of the first frame portion includes:

an inclined surface inclined downward;

a horizontal surface configured to continuously extend from the inclined surface and be parallel to a ground surface; and a depression and protrusion surface configured to continuously extend from the horizontal surface, and provided with alternating depressions and protrusions.

3. The electric range supporting bracket assembly of claim 1, wherein the support part includes:

one or more first support portions configured to be inserted into an inner space of the frame part and guide vertical movement;

a second support portion located between the first support portions, and configured to receive external force required for elevation; and a third support portion configured such that the electric range is seated thereon.

4. The electric range supporting bracket assembly of claim 3, wherein a bottom surface of the second support portion is provided with an internal space recessed upward, and an external force application member is selectively attached to and detached from the internal space.

5. The electric range supporting bracket assembly of claim 4, wherein:

the external force application member includes a first external force application member having a height equal to a depression depth of the internal space, and a second external force application member having a height higher than a depression depth of the internal space and protruding downward; and the external force application member is replaceable depending on a thickness of the countertop.

6. The electric range supporting bracket assembly of claim 3, wherein a top surface of the third support portion has grooves depressed in a downward direction and a hole penetrating in a vertical direction.

7. The electric range supporting bracket assembly of claim 1, wherein the adjustment part includes:

a first adjustment portion in a form of a nut that is inserted into and fixed to the inner space of the frame part; and a second adjustment portion in a form of a bolt that is fastened to the first adjustment portion.

8. The electric range supporting bracket assembly of claim 7, wherein the adjustment part further includes a third adjustment portion in a form of a nut that is located in a space outside the frame part and is fastened to the second adjustment portion.

* * * * *